United States Patent [19]

Tse et al.

[11] Patent Number: 4,946,324

[45] Date of Patent: Aug. 7, 1990

[54] RAILROAD FLATCAR WITH TURNTABLE

[75] Inventors: Yan H. Tse, Plymouth Meeting, Pa.; Dennis L. Beecher, Hammonton, N.J.

[73] Assignee: Consolidated Rail Corporation, Philadelphia, Pa.

[21] Appl. No.: 297,305

[22] Filed: Jan. 13, 1989

[51] Int. Cl.[5] ..... B61D 47/00

[52] U.S. Cl. ..... 410/1; 414/333

[58] Field of Search ..... 244/137.1; 410/1, 3, 410/52, 59; 414/333, 340, 343

[56] References Cited

U.S. PATENT DOCUMENTS

| | | | |
|---|---|---|---|
| 3,635,362 | 1/1972 | Pratt | 410/1 X |
| 3,861,541 | 1/1975 | Taft et al. | 214/38 C |
| 3,884,158 | 5/1975 | Rumell | 410/1 |
| 4,144,984 | 3/1979 | Saunders | 220/1.5 |
| 4,209,887 | 7/1980 | Saunders | 29/200 |
| 4,231,481 | 11/1980 | Nash et al. | 220/1.5 |
| 4,385,857 | 5/1983 | Willetts | 410/53 |
| 4,452,147 | 6/1984 | Jwuc | 105/4 A |
| 4,547,107 | 10/1985 | Krause | 410/58 |
| 4,559,040 | 7/1986 | Rasmussen | 414/786 |
| 4,597,337 | 7/1986 | Willetts | 105/4 R |
| 4,665,834 | 5/1987 | van Iperen | 105/4.1 |
| 4,669,391 | 6/1987 | Wicks et al. | 105/4.3 |
| 4,679,979 | 7/1987 | Rasmussen | 414/786 |
| 4,686,907 | 8/1987 | Woollam et al. | 105/4.1 |
| 4,690,608 | 9/1987 | Rasmussen | 414/529 |

FOREIGN PATENT DOCUMENTS

| | | | |
|---|---|---|---|
| 848728 | 9/1960 | United Kingdom | 410/1 |

*Primary Examiner*—Duane A. Reger

*Attorney, Agent, or Firm*—Woodcock, Washburn, Kurtz, Mackiewicz & Norris

[57] ABSTRACT

A railroad car adapted to receive at least one container from a truck positioned along the railroad car includes a deck mounted on wheels and at least one turntable rotatably mounted on the deck. The turntable includes a pair of spaced, parallel guide tracks which can slidably receive and support a container. A shuttle bar extends transversely across and is slidably mounted on the deck. The shuttle bar is connected to the turntable so that sliding movement of the shuttle bar rotates the turntable between a position in which the guide tracks extend longitudinally along the deck and a position in which the guide tracks extend across the width of the deck. The shuttle bar has hooks on its ends which can be engaged by a bail on the truck to allow the truck to move the shuttle bar and thus rotate the turntable. When the turntable is in its position extending across the width of the deck, the truck can slide a container either onto or off of the guide tracks so as to load or unload a container from the railroad car.

19 Claims, 5 Drawing Sheets

RAILROAD FLATCAR WITH TURNTABLE

FIELD OF THE INVENTION

The present invention relates to a railroad flatcar having thereon at least one turntable, and, more particularly, to a flatcar having a turntable on which a bulk carrier container can be easily mounted and removed by a truck.

BACKGROUND OF THE INVENTION

Presently, the railroad cars used for containing bulk material are large container cars in which the container compartment is the full size of the car. Special equipment is required to fill the container car with the bulk material and remove the bulk material from the car, generally through doors in the bottom of the car. However, many businesses which desire to ship bulk material are not located near the railroad tracks and do not have easy access to the special equipment needed to transfer the bulk material from trucks to the railroad container car. Also, the business receiving the bulk material may likewise not be near the railroad tracks or have easy access to the special equipment required to transfer the bulk material from the railroad container cars to trucks. There are presently on the market trucks for handling bulk material, such as refuse, having a container which can be easily and quickly slid off of or on to a hoist at the back of the truck. One of such trucks is a Dempster Dumpster with a Dinosaur container made by the Dempster Dumpster systems division of Carrier Corporation of Knoxville, Tenn. Another such truck is made by Accurate division of Western Capital Corporation of Williamstown, N.J. Since these trucks can transfer bulk material in containers which can be easily removed from and replaced on the trucks, it would be desirable to have a railroad flatcar which can easily receive one or more of the containers from such tracks and allow the containers to be transferred back to the trucks. This would allow the delivering business to transfer bulk material in the containers by truck to a railroad siding where the containers could be easily and quickly transferred to the flat car. At the other end of the delivery, the containers could be transferred from the flatcar to a similar truck for delivery to the receiving business.

SUMMARY OF THE INVENTION

A railroad car having a substantially flat deck mounted on wheels for riding on a track, and at least one turntable rotatably mounted on the deck. The turntable includes means for slidably receiving a container from a truck positioned along one side of the railroad car and means operable by the truck for rotating the turntable.

DETAILED DESCRIPTION OF PREFERRED EMBODIMENT

Figure 1:
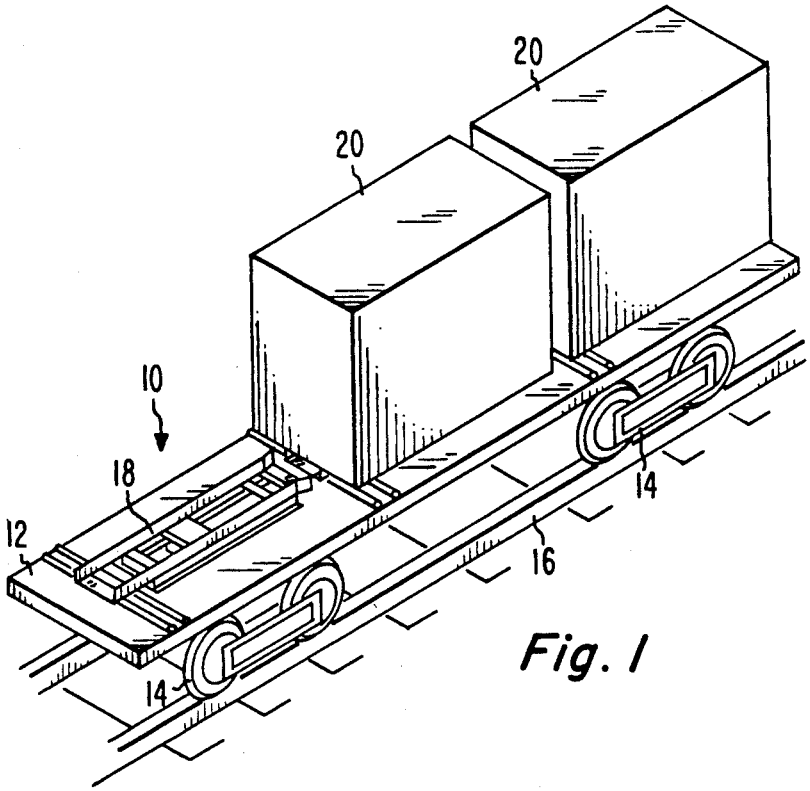
FIG. 1 is a perspective view of the railroad car of the present invention.

Referring initially to FIG. 1, the railroad car of the present invention is generally designated as 10. Railroad car 10 includes a flat deck 12 mounted on wheels 14 which are adapted to ride on railroad tracks 16. On the deck 12 are a plurality of turntables, generally designated as 18, each of which is adapted to have a container 20 mounted thereon. As shown, the railroad car 10 has three turntables !8 to have three containers 20 carried thereon. However, the railroad car 10 can have any desired number of turntables 18 depending on the size of the railroad car 10 and the size of the containers 20. The containers 20 can be open at their tops or can be completely enclosed. As will be explained later, the turntables 18 are adapted to have the containers 20 placed thereon or removed therefrom by a truck positioned at either side of the railroad car 10.

Figure 4:
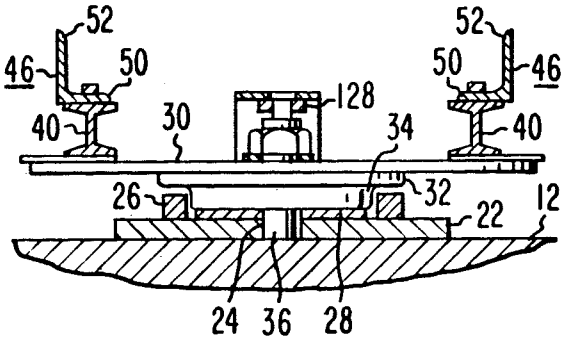
FIG. 4 is a sectional view across the turntable.

As shown in FIG. 4, the deck 12 has a metal support plate 22 mounted thereon for each of the turntables 18. The support plate 22 has a hole 24 therethrough, and an annular guide and bearing ring 26 projecting upwardly from its top surface. The guide ring 26 is larger in diameter than and concentric with the hole 24. A bearing liner 28 covers the surface of the support plate 22 within the guide ring 26.

Figure 3:
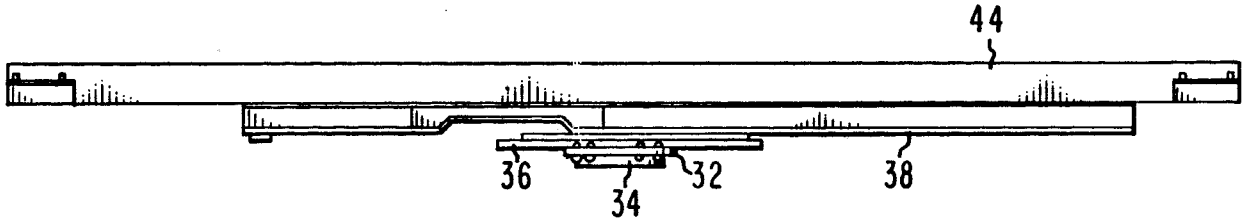
FIG. 3 is a side view of the turntable used on the railroad car of the present invention.
Figure 5:
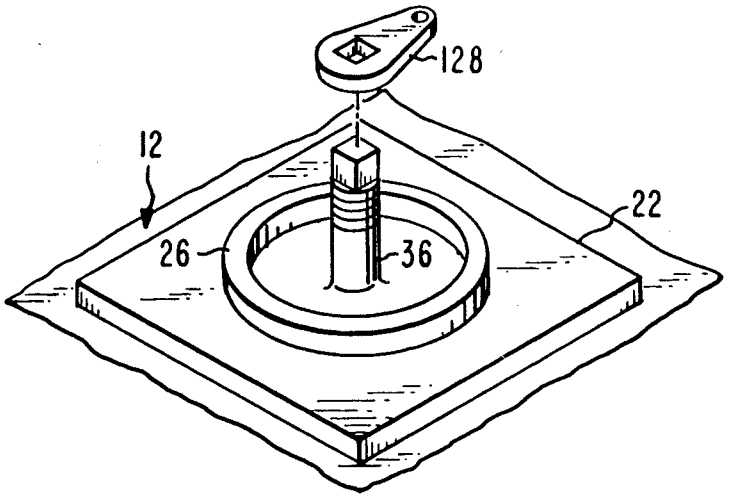
FIG. 5 is a perspective view of the base plate and bearing pin assembly.
Figures 6, 7:
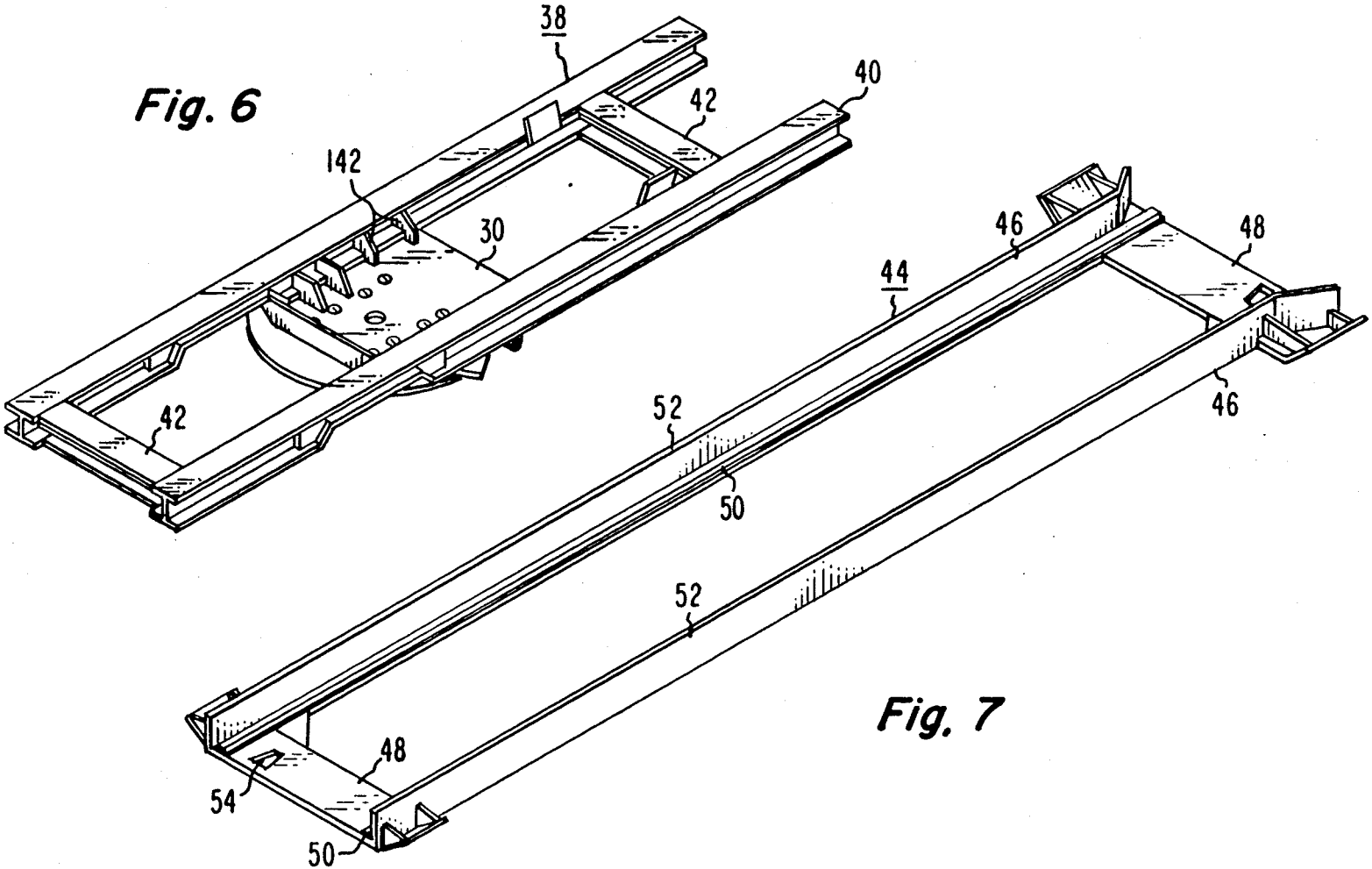
FIG. 6 is a perspective view of the upper portion of the turntable.
FIG. 7 is a perspective view of container guide track of the turntable.

The turntable 18 includes a lower turntable plate 30 mounted on a bearing support 32. The bearing support 32 includes a circular hub 34 which fits within the guide ring 26 and is rotatable supported on the bearing liner 28. As shown in FIG. 5, a bearing pin 36 is fixed within the hole 24 and projects from the support plate 22. The bearing pin 36 extends through the bearing support 32 which is rotatable thereon. As shown in FIGS. 3, 4, and 6, mounted on the lower turntable plate 30 is an upper turntable section 38. The upper turntable section 38 includes a pair of elongated I-beams 40 secured together in spaced, parallel relation by a pair of cross I-beams 42. The elongated beams 40 are mounted on the lower turntable plate 30.

On the upper turntable section 38 is a container guide track 44. As shown in FIG. 7, the container guide track 44 includes a pair of L-shaped beams 46 secured together in spaced, parallel relation by a pair of end plates 48. As shown in FIG. 4, the bases 50 of the L-shaped beams 46 are seated on and secured to the tops of the I-beams 40. The bases 50 extend toward each other from the upright legs 52 to form a track for the undercarriage of a container 20. At one end of the guide track 44, the legs 52 are bent outwardly away from each other to form a funnel like portion to guide the undercarriage of a container 20 onto the guide track 44. Each of the end plates 48 has an opening 54 therethrough to receive a locking member as will be explained. As shown in FIG. 3, the guide track 44 is longer than the upper turntable section 38 so that it projects beyond both ends of the upper turntable section 38.

Figure 8:
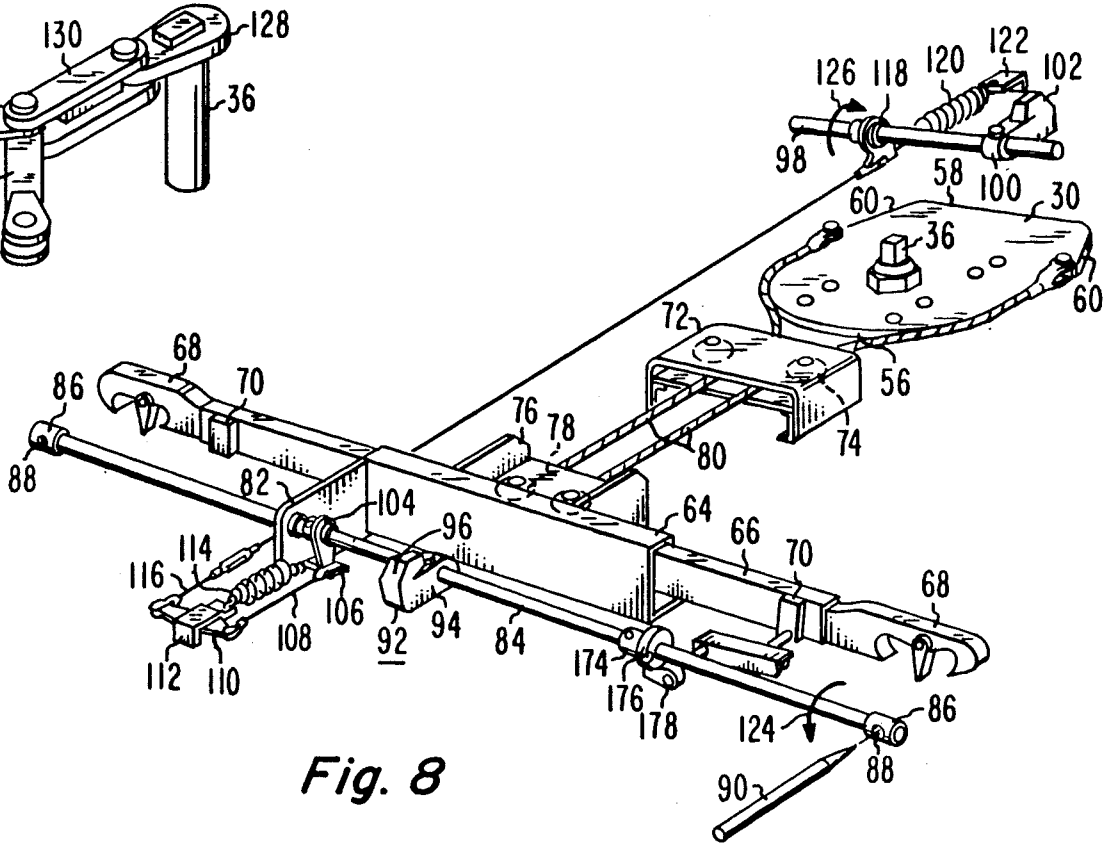
FIG. 8 is a perspective view of the lower portion of the turntable showing the shuttle bar assembly which operates the turntable.

As shown in FIG. 8, the lower turntable plate 30 is a plate having a circular peripheral portion 56 and a straight peripheral portion 58 tangential to the circular portion 56, and ears 60 projecting outwardly from the ends of the circular portion 56 adjacent the ends of the straight portion 58. The bearing pin 36 extends through the lower turntable 30 at the center of the circular peripheral portion 56. A shuttle guide 64 is mounted on the deck 12 of the railroad car 10 adjacent but spaced from the lower turntable 30 and extending transversely across the deck 12. A shuttle bar 66 is slidably supported in and projects beyond both ends of the shuttle guide 64. A hook 68 is on each end of the shuttle bar 66. The shuttle bar 66 is of a length that when it is centered in the shuttle guide 64 and the guide track 44 extends longitudinally along the railroad car 10, the hooks 68 project slightly from the sides of the guide track 44. A stop member 70 is on the side of the shuttle bar 66 adjacent each hook 68 so as to limit the distance that the shuttle bar 66 can slide in the shuttle guide 64.

Figure 12:
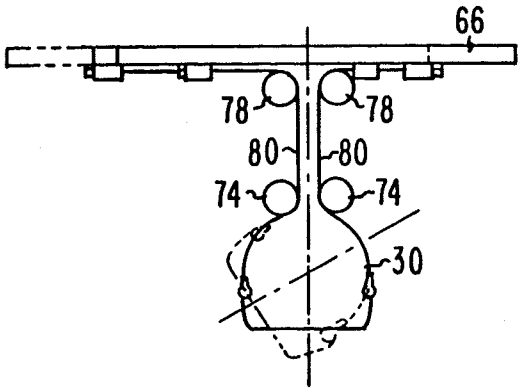
FIG. 12 is a schematic view of the turntable illustrating the manner of operation thereof.

A first sheave wheel bracket 72 is mounted on the railroad car deck 12 between the lower turntable plate 30 and the shuttle guide 64 and adjacent the lower turntable plate 30. The sheave wheel bracket 72 has a pair of spaced sheave wheels 74 rotatably mounted thereon. A second sheave wheel bracket 76 is mounted on the railroad car deck 12 between t he lower turntable plate 30 and the shuttle guide 64 and adjacent the shuttle guide 64. The second sheave wheel bracket 76 has a pair of spaced sheave wheels 78 mounted thereon. A pair of cables 80 each has one end thereof secured to a separate ear 60 of the lower turntable plate 30. The cables 80 extend around the circular peripheral portion 56 of the lower turntable plate 30 and then between and against the sheave wheels 74. The cables 80 then extend between and against the sheave wheels 78 and away from each other along the side of the shuttle bar 66 as shown in FIG. 12. The other ends of the cable 80 are secured to the shuttle bar 66. Thus, sliding movement of the shuttle bar 66 in either direction will pull on one of the cables 80 causing the lower turntable plate 30 to rotate in one direction or the other. The stop members 70 are positioned to limit the total rotation of the turntable plate 30 to about 64 degrees.

A bracket 82 projects from the side of the shuttle guide 64 away from the lower turntable plate 30. An elongated rod 84 extends through and is rotatably supported in the bracket 82. The rod 84 is substantially parallel to and of the same length as the shuttle bar 66. The rod 84 has a head 86 on each end thereof, and the head 86 has a hole 88 therethrough into which a pry bar 90 can be inserted to rotate the rod 84. A substantially L-shaped lock bar 92 is mounted on the rod 84 with the rod 84 extending through the end of the leg 94 of the lock bar 92. As will be explained in detail later, the lock bar 92 is positioned along the rod 84 so that when the foot 96 of the lock bar 92 is rotated upwardly and the guide track 44 is extending longitudinally along the railroad car deck 12, the foot 96 will extend into one of the lock openings 54 in the guide track 44.

A second elongated rod 98 extends parallel to the rod 84 but on the other side of the lower turntable plate 30. The second rod 98 is rotatably mounted in a bracket, not shown, mounted on the railroad car deck 12. A locking bar 100 of the same structure as the locking bar 92 is on the rod 98 and is positioned so that when its foot 102 is rotated upwardly, it will extend into the other lock opening 54 in the guide track 44. A lever 104 is mounted on and extends downwardly from the bar 84 and has a crossplate 106 on its end. A cable 108 is secured at one of its ends to one end of the cross-plate 106 and at its other end to an end of a pivot plate 110. The pivot plate 110 is pivotally mounted on a bracket 112 mounted on the deck 12. A spring 114 is mounted between the bracket 112 and the other end of the crossplate 106. A cable 116 is connected at one of its ends to the other end of the pivot plate 110 and at its other end to a lever 118 mounted on and extending downwardly from the rod 98. A spring 120 is connected between the lever 118 and a bracket 122 mounted on the deck 12. Thus, rotation of the rod 84 in the direction of the arrow 124 to rotate the locking bar 92 out of its upright locking position pulls on the cable 116 causing the rod 98 to rotate in the direction of the arrow 126 and move its locking bar 100 from its upright locking position. Rotation of the rod 84 in the opposite direction to move the locking bar 92 into its upright locking position releases the pull on the cable 116 allowing the spring 120 to rotate the rod 98 in the direction to move its locking bar 100 into its upright locking position.

Figure 9:
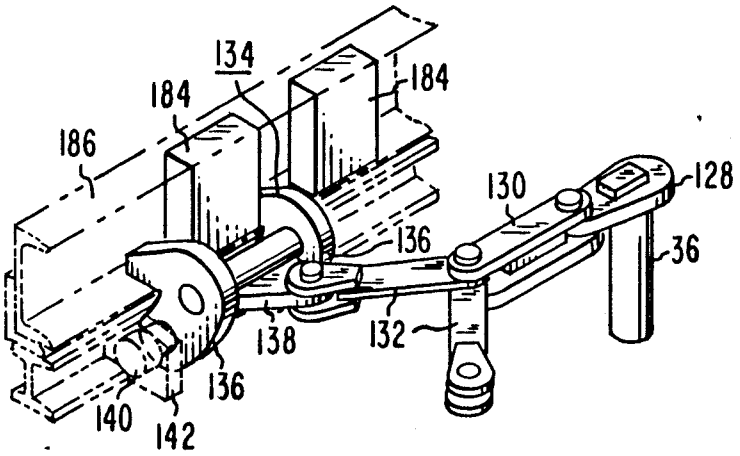
FIG. 9 is a perspective view of container locking mechanism of the turntable.

Referring to FIG. 9 there is shown a mechanism for locking a container 20 onto the turntable 18. The container locking mechanism includes a substantially oblong plate 128 mounted on the top end of the bearing pin 36 so as to remain stationary with the bearing pin 36. Linkage arms 130 are pivotally mounted at one of their ends to the oblong plate 128. A pair of connecting arms 132 are pivotally connected to the other ends of the linkage arms 130. Each of the connected arms 132 is pivotally connected to a separate locking member 134 mounted on each of the I-beams 40 of the upper turntable 38. Each locking member 134 includes a pair of substantially L-shaped locking bars 136 mounted in spaced, parallel relation by a connecting plate 138. The connecting plate 138 is pivotally mounted between the pair of locking bars 136. The connecting arm 132 is connected to the connecting plate 138. The locking bars 136 are pivotally mounted on a pin 140 extending between a pair of spaced support plates 142 on the I-beam 40.

Figure 11:
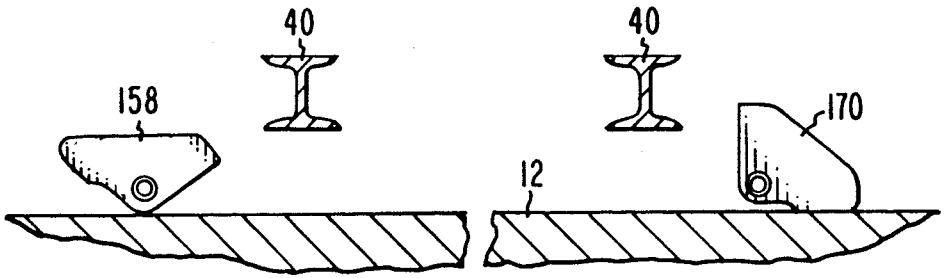
FIG. 11 is a sectional view showing the manner that the failsafe operates.
Figure 10:
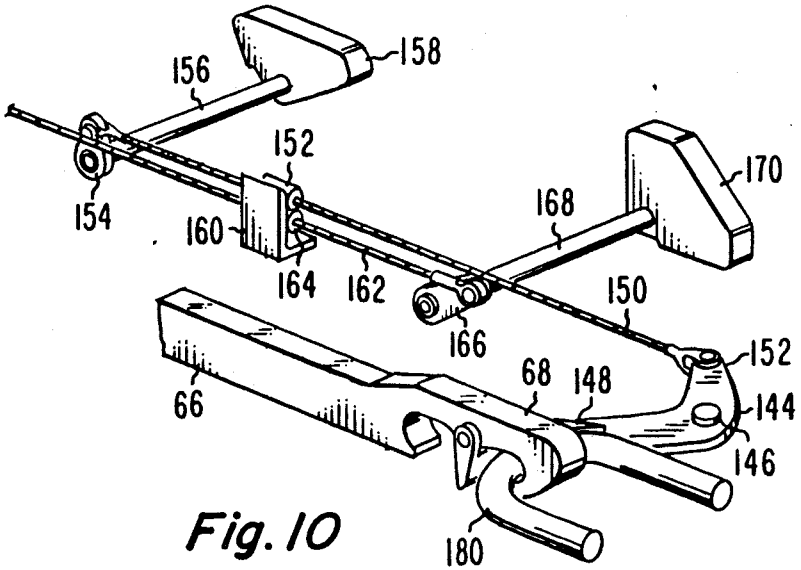
FIG. 10 is a perspective view of the failsafe lock of the turntable.

Referring to FIGS. 10 and 11, there is shown a fail-safe locking mechanism. The fail-safe locking mechanism includes a pivot arm 144 pivotally mounted intermediate its ends on a pin 146 secured to the deck 12 adjacent the hook 68 on the end of the shuttle bar 66. One end 148 of the pivot arm 144 is adjacent the hook 68. A cable 150 is connected at one end to the other end 152 of the pivot arm 144. The cable 150 extends through a guide 152 and has its other end connected to a lever 154 projecting from the end of a shaft 156. A substantially triangular locking plate 158 is on the other end of the shaft 156 which is secured to an apex of the plate 158. The guide 152 is on a bracket 160 which is mounted on the deck 12. The shaft 156 is rotatably supported in a bearing member, not shown. A second pivot arm, not shown, similar to the pivot arm 144 is pivotally mounted adjacent the hook 68 at the other end of the shuttle arm 66. A cable 162 extends from the second pivot arm, through a guide 164 mounted on the bracket 160 and is connected to a lever 166 extending from the end of a shaft 168. A triangular locking plate 170 is on the end of the shaft 168. As shown in FIG. 10, the shafts 156 and 168 are parallel and extend lOngitudinally along and adjacent to the deck 12. The shafts 156 and 168 are spaced apart a distance such that the locking plates 158 and 170 are on opposite sides of the upper turntable 38 when the upper turntable 38 is extending longitudinally along the deck 12.

Figure 2:
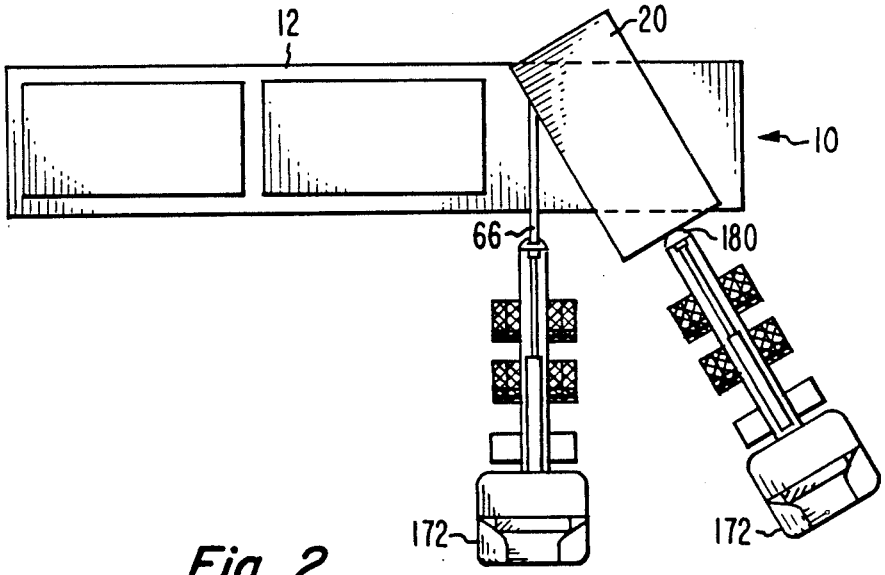
FIG. 2 is a schematic view of the railroad car illustrating the method of loading and unloading the car.

To remove a container 20 from the railroad car 10 of the present invention, a truck 172 of the type of a Dempster Dumpster is backed up to one side of the railroad car 10 as shown in FIG. 2. The driver exits the truck 172 and inserts pry bar 90 into the hole 88 in the head 86 on the end of the anti-rotation lock torsion bar 84. The driver rotates the bar 84 in the direction of the arrow 124 in FIG. 8 to rotate the lock bar 92 out of the lock opening 54 in the guide track 44. This also rotates the rod 98 to rotate the lock bar 100 out of its lock opening 54. A camming member 174 on the rod 84 has a notch 176 therein which is engaged by a release pawl 178 to hold the lock bars 92 and 100 in open position.

The driver then reenters the truck 172 and backs it up to the end of the shuttle bar 66. The truck 172 has a bail 180 on its back end which the driver inserts into the hook 68 on the end of the shuttle bar 66. Insertion of the bail 180 in the hook 68 presses on the end 148 of the fail safe pivot arm 144 as shown in FIG. 10. Pressing on the fail safe arm 144 pulls on the cable 150 causing the locking plate 158 to rotate out of locking position.

With the truck 172 remaining stationary, the driver moves the bale 180 forward by means of hydraulic equipment on the truck 172 pulling on the shuttle arm 66. As the shuttle arm 66 moves, the release pawl 178 is rotated out of the notch 176 so as to reset the anti-rotation lock in the spring loaded lock position. As the shuttle arm 66 continues to be pulled outwardly, it pulls on one of the cables 80 causing the lower turntable 30 to rotate as shown in FIG. 12. The lower turntable 30 is rotated to the position shown in dash lines in FIG. 12. This also rotates the upper turntable assembly 38 so as to rotate the container 20 to a position where it extends at an angle across the deck 12 of the railroad car 10 as shown in FIG. 2.

When the shuttle bar 66 has been moved to the position where the bail 180 passes over the edge of the deck 12, pressure is removed from the end 148 of the fail safe pivot arm 144, thus releasing tension on cable 150 and allowing locking plate 158 to return to its locked position. As lower turntable 30 rotates about bearing pin 36, plate 128 on the end of bearing pin 36 remains aligned longitudinally with the deck 12 of car 10. This pulls the linkage arms 132 together to pivot the locking member 134 away from the locking bars 184 on the sled 186 of the container 20, shown in FIG. 9. This releases the container 20 so that it can be slid from the guide track 44.

The driver then releases the bail 180 from the hook 68 and maneuvers the truck 172 so that the back end of the truck 172 is under the end of the container 20 which projects beyond the side of the deck 12 of the railroad car 10 as shown in FIG. 2. Using the equipment on the truck 172, the container 20 is pulled from the guide track 44 onto the truck 172. The truck 172 can then carry the container away to its destination.

Another container 20 can now be loaded onto the railroad car 10 by backing a truck 172 having a container 20 thereon up to the end of the guide track 44 which is at the side of the deck 12 of the railroad car 10. The container 20 is pushed rom the truck 172 onto the guide track 44 using equipment on the truck 172. Once the container 20 is partially on the guide track 44, the bail 180 of the truck 172 can be used to push the container 20 completely onto the guide track 44. Once the container 20 is off of the truck 172 and onto the guide track 44, the driver maneuvers the truck 172 so that the bail 180 is at the end of the shuttle arm 66. The driver inserts the bail 180 into the hook 68 on the end of the shuttle arm 66 and then, using the equipment on the truck 172, hydraulically moves the bale 180 so as to move the shuttle arm 66 back to its neutral position. This pulls on the other cable 80 to rotate the lower turntable 30 back to its position shown in full line in FIG. 12. Rotation of the lower turntable 30 also rotates the upper turntable assembly 38 and the container 20 thereon to its position where it extends longitudinally along the deck 12 of the railroad car 10.

As the lower turntable 30 is rotated, the plate 128 on the bearing pin 36 remains aligned longitudinally with the deck 12 of the car 10 thereby pushing the ends of the linkage arms 132 away from each other. This pushes on the locking member 134 to pivot them back into locking position with the locking bars 184 on the sled 186 of the container 20. As the bail 180 is pushed back across the edge of the deck 12, the failsafe pivot arm 144 is pivoted to pull on the cable 150 and rotate the locking plate 158 to its unlock position. When the upper turntable 38 is rotated back to its centered position, the springs 114 and 120 rotate the rods 84 and 98 to move the lock bars 92 and 100 back into the lock openings 54 in the guide track 44 to lock the upper turntable assembly 38 from further rotation. The driver then releases the bail 180 from the hook 68 so that the truck 172 can be driven away. As the bail 180 is removed from the hook 68 the force on the failsafe lever arm 144 is removed allowing the locking plate 158 to return to its lock position.

Thus, there is provided by the present invention, a railroad car 10 having a turntable thereon which allows for a container to be easily and quickly loaded onto and removed from the railroad car from and to a truck positioned at the side of the railroad car. The containers are smaller than the normal length of a railroad car so that two or more containers can be mounted on a railroad car. The loading of the container onto the railroad car and unloading of the container can be achieved with no special equipment other than that which is already on the truck. The loading and unloading can take place anywhere that a road is along side of the railroad track so as to allow the truck to be driven up to the railroad car. Also, the loading and unloading can be done from either side of the railroad car.

I claim:

1. A railroad car comprising:

a substantially flat deck mounted on wheels for rolling on a track;

at least one turntable rotatably mounted on said deck;

means on said turntable for slidably receiving a container from a truck which is along a side of said railroad car; and means on said deck operably by said truck for rotating said turntable;

wherein said turntable includes a lower turntable plate which is supported on said deck for rotation about an axis perpendicular to said deck, and said means for rotating said turntable includes a shuttle bar slidably mounted on and extending transversely across said deck and cable connecting said shuttle bar to said lower turntable plate so that sliding movement of said shuttle bar rotates said lower turntable plate.

2. A railroad car in accordance with claim 1 in which the turntable includes an upper turntable assembly including a rectangular frame mounted on the lower turntable plate and a pair of spaced, parallel guide tracks mounted on the sides of the frame for receiving the container.

3. A railroad car in accordance with claim 2 including a hook on each end of the shuttle bar which can be engaged by the truck for sliding the bar in either direction.

4. A railroad car in accordance with claim 3 including locking means mounted on said deck and engagable with the turntable to prevent rotation of the turntable when the container extends longitudinally along the deck.

5. A railroad car in accordance with claim 4 in which the turntable rotation locking means includes a rod extending transversely across and rotatably mounted on said deck, a locking bar on said rod and projecting therefrom, and means for rotating said rod to move said locking bar into and out of engagement with the turntable.

6. A railroad car in accordance with claim 5 in which the turntable includes a separate plate extending between and connected to the ends of the guide tracks, and an opening in each plate which is adopted to receive a locking bar to lock the turntable from rotating.

7. A railroad car in accordance with claim 6 in which locking rod is along one end of the guide tracks when the turntable extends longitudinally along the deck, and a second locking rod extends transversely across and is rotatably mounted on said deck adjacent the other end of the guide tracks, a locking bar is on said second rod, and said second rod is connected to said first rod so that rotation of the first rod also rotates the second rod to move the locking bars into and out of the openings in the plates at both ends of the guide tracks.

8. A railroad car in accordance with claim 7 in which the locking rods are connected by a cable connected to linkages on the rods.

9. A railroad car in accordance with claim 4 including means on said turntable for releasably locking a container one said guide tracks.

10. A railroad car in accordance with claim 9 in which the container locking means includes a locking member pivotally mounted on each of the sides of the turntable frame and means connected to each locking member for pivoting the locking members into and out of engagement with the container upon rotation of the turntable.

11. A railroad car in accordance with claim 10 in which the means for pivoting the locking members includes a pin fixed to a metal support plate on said deck and projecting upwardly through the lower turntable plate which is rotatable thereon, a plate mounted on the end of the pin and projecting radially therefrom, and linkage between the plate and the locking members.

12. A railroad car in accordance with claim 4 including a failsafe rotation preventing means for the turntable operably the movement of the shuttle bar to allow the rotation of the turntable.

13. A railroad car in accordance with claim 12 in which the failsafe rotating preventing means includes a separate locking plate mounted adjacent each of the sides of the turntable frame and rotatable between a position in which they project above the lower edge of the frame to prevent rotation of the turntable and a position below the lower edge of the frame to permit rotation of the turntable, and means at each hook of the shuttle bar and connected to the locking plates to rotate them between the two positions.

14. A railroad car in accordance with claim 13 in which each of the locking plates is mounted on a shaft for rotating the locking plates, a separate pivot arm is pivotally mounted adjacent each end of the shuttle bar with one end being adjacent the hook on the end of the shuttle bar, and a cable is connected between the other end of each pivot arm and a lever on one of the shafts for rotating the shaft by the pivot arm upon movement of the shuttle bar.

15. A railroad car comprising:

a substantially flat deck mounted on wheels for rolling on a track;

at least one support plate mounted on said deck having a hole therethrough, a guide ring projecting upwardly therefrom and surrounding the hole, and a bearing surface between the guide ring and the hole;

a bearing pin fixedly mounted in the hole in the support plate and projecting upwardly from the support plate;

a circular hub rotatably seated on said bearing surface within the guide ring and having an opening therethrough through which the bearing pin rotatable extends;

a lower turntable plate mounted on said hub;

a rectangular turntable frame mounted on said lower turntable plate;

a pair of spaced, parallel guide tracks mounted along the sides of the turntable frame and projecting beyond the ends of the frame, said tracks adapted to slidably receive and support a container from a truck positioned along a side of the railroad car; and means on said deck operable by the truck for rotating said lower turntable plate.

16. A railroad car in accordance with claim 15 in which the means for rotating the lower turntable plate includes a shuttle bar slidably mounted on and extending transversely across the deck, a hook on each end of the shuttle bar adapted to be engaged by the truck to slide the shuttle bar, and cables connecting the shuttle bar to the turntable plate so that sliding movement of the shuttle bar rotates the turntable plate.

17. A railroad car in accordance with claim 16 including locking means mounted on said deck and engagable with the turntable to prevent rotation of the turntable when the container extends longitudinally along the deck, and means for releasing said locking means to allow rotation of the turntable.

18. A railroad car in accordance with claim 17 including means on said turntable for releasably locking a container on said guide tracks.

19. A railroad car in accordance with claim 18 including a plurality of support plates mounted in spaced relation along the deck, each of the support plates having a guide ring and a hole therethrough, a separate bearing pin mounted in each hole and projecting upwardly from the support plate, a separate hub rotatably mounted on each of said support plates, a separate turntable mounted on each of the hubs, and a separate shuttle bar mounted on the deck for each turntable and connected to the respective turntable to allow rotation of each turntable.

* * * * *